US010807779B2

(12) United States Patent
Branyon et al.

(10) Patent No.: US 10,807,779 B2
(45) Date of Patent: Oct. 20, 2020

(54) DIE CUT OPENING FOR MULTI-LAYER FLEXIBLE PACKAGE

(71) Applicant: SONOCO DEVELOPMENT, INC., Hartsville, SC (US)

(72) Inventors: Jacob Donald Prue Branyon, Hartsville, SC (US); Donovan Young, Hartsville, SC (US); Eugene Smith, Charlotte, NC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 16/292,410

(22) Filed: Mar. 5, 2019

(65) Prior Publication Data

US 2019/0193907 A1 Jun. 27, 2019

Related U.S. Application Data

(62) Division of application No. 14/581,091, filed on Dec. 23, 2014, now Pat. No. 10,273,068.

(51) Int. Cl.
*B65D 75/00* (2006.01)
*B65D 75/58* (2006.01)

(52) U.S. Cl.
CPC ..... *B65D 75/5827* (2013.01); *B65D 75/5833* (2013.01); *B65D 75/5855* (2013.01); *B65D 2575/586* (2013.01); *Y10T 156/1064* (2015.01); *Y10T 156/1082* (2015.01)

(58) Field of Classification Search
None
See application file for complete search history.

(56) References Cited

U.S. PATENT DOCUMENTS

| | | | |
|---|---|---|---|
| 3,982,685 | A | 9/1976 | Shimada |
| 4,420,080 | A | 12/1983 | Nakamura |
| 4,610,357 | A | 9/1986 | Nakamura |
| 4,651,874 | A | 3/1987 | Nakamura |

(Continued)

FOREIGN PATENT DOCUMENTS

| | | |
|---|---|---|
| CA | 2 671 664 A1 | 1/2010 |
| EP | 0 193 130 A2 | 9/1986 |

(Continued)

OTHER PUBLICATIONS

Office Action for Japanese Patent Application No. 2018-169501 dated Jul. 31, 2019.

(Continued)

*Primary Examiner* — Linda L Gray
(74) *Attorney, Agent, or Firm* — Nelson Mullins Riley & Scarborough LLP

(57) ABSTRACT

A reclosable package is described that includes inner and outer film layers. Each of the inner and outer film layers includes die cuts that are designed to create a peelable flap portion that, when pulled back by the user, reveals an opening of the package for providing access to the contents of the package. In particular, the inner film layer has an inner die cut that includes a cross-directional cut line. While the cross-directional cut line in conventional packages is a straight line, the package described herein uses a line that has one or more radii of curvature. In this way, the vibrations that may otherwise be generated during the rotary die cutting process are reduced, and more consistent cut depths can be achieved.

19 Claims, 8 Drawing Sheets

(56) References Cited

U.S. PATENT DOCUMENTS

| | | | |
|---|---|---|---|
| 4,653,250 | A | 3/1987 | Nakamura |
| 4,739,879 | A | 4/1988 | Nakamura |
| 4,790,436 | A | 12/1988 | Nakamura |
| 5,167,455 | A | 12/1992 | Forman |
| 5,333,735 | A | 8/1994 | Focke et al. |
| 5,945,145 | A | 8/1999 | Narsutis |
| 6,113,271 | A | 9/2000 | Scott et al. |
| 6,375,067 | B1 | 4/2002 | Moriyama |
| 6,589,622 | B1 | 7/2003 | Scott |
| 7,963,413 | B2 | 6/2011 | Sierra-Gomez et al. |
| 2004/0035719 | A1 | 2/2004 | Ebbers et al. |
| 2006/0171611 | A1 | 8/2006 | Rapparini |
| 2008/0240627 | A1 | 10/2008 | Cole |
| 2010/0018974 | A1 | 1/2010 | Lyzenga |
| 2010/0092112 | A1 | 4/2010 | Goglio |
| 2013/0233879 | A1 | 9/2013 | Thimmesch |
| 2014/0000219 | A1 | 1/2014 | Pezzoli |
| 2015/0307264 | A1 | 10/2015 | Boswell |

FOREIGN PATENT DOCUMENTS

| | | | |
|---|---|---|---|
| EP | 2 412 644 | A1 | 2/2012 |
| JP | H07-277379 | A | 10/1995 |
| JP | H07-2773798 | A | 10/1995 |
| JP | 2002-052496 | A | 2/2002 |
| JP | 2008-502555 | T | 12/2005 |
| JP | 2008-502555 | A | 1/2008 |
| JP | 2011-513153 | T | 9/2009 |
| JP | 2010-047320 | A | 3/2010 |
| JP | 20110-228797 | A | 10/2010 |
| JP | 2010-228797 | A | 3/2012 |
| JP | 2013-246299 | A | 12/2013 |
| WO | WO 2005/123535 | A1 | 12/2005 |
| WO | WO 2014/164416 | A1 | 10/2014 |
| WO | WO 2014/186572 | A2 | 11/2014 |

OTHER PUBLICATIONS

International Search Report and Wirtten Opinion for Application No. PCT/IB2015/058854 dated Feb. 1, 2016.

2nd Examination Report for Australian Patent Application No. 2015370528 dated Mar. 16, 2018.

Office Action for Japanese Patent Application No. 2017-533870 dated Apr. 13, 2018 (no English translation available).

Office Action for Canadian Patent Application No. 2,971,992 dated Jun. 8, 2018.

DIE CUT OPENING FOR MULTI-LAYER FLEXIBLE PACKAGE

CROSS-REFERENCE TO RELATED APPLICATIONS

This application is a divisional of U.S. patent application Ser. No. 14/581,091, filed Dec. 23, 2014 entitled "Die Cut Opening Multi-Layer Flexible Package", which is incorporated herein in its entirety.

BACKGROUND

The present disclosure relates in general to packaging for products, and more particularly to packaging constructed from flexible film-based materials. The disclosure is especially concerned with packages having one or more die cuts that define a peelable portion and/or package integrity features for creating an opening to the package and methods for die cutting the peelable portion and opening.

Flexible film-based materials can be used to construct packages for products. Such a package can include an opening that is created when one layer of a multi-laminate construction is partially peeled away from another layer. For example, an outer film layer may be laminated to an inner film layer, and an opening may be cut in each film layer in such a way as to create a portion of the package that can be removed by the consumer to reveal the opening of the package. Thus, a consumer, by peeling back portions of the outer film layer and the inner film layer, can open the package and access contents of the package (e.g., food items, such as cookies). In some cases, the peelable portion may be designed to be re-adhered to the rest of the package to provide a reclosing feature for storing unused contents of an opened package.

BRIEF SUMMARY

Embodiments of the invention described herein provide improved packages and methods for die cutting package openings that allow for more consistent cut depths when creating the various die cuts that form a peelable portion and opening of a flexible package. In particular, embodiments of the packages and methods described below include a cross-directional cut line that includes at least one radius of curvature, such that vibrations during the die cutting process are reduced and more consistent and reproducible die cut depths through particular layers of the multi-layer laminate can be achieved, thereby reducing tolerances and improving the overall performance of the flexible package.

In some embodiments, a package is provided that comprises an outer film layer comprising an outer die cut, wherein the outer die cut defines a peripheral edge of a peelable flap portion of the package, and an inner film layer laminated to the outer film layer and comprising an inner die cut. The inner die cut may define a location of an opening of the package, may be formed inwardly of the outer die cut, and may be formed on the peelable flap portion. The inner die cut may comprise a first cross-directional cut line, first and second longitudinal cut lines extending continuously lengthwise from opposite ends of the first cross-directional cut line, respectively, and a second cross-directional cut line extending continuously between the first and second longitudinal cut lines opposite the first cross-directional cut line. The second cross-directional cut line may have a non-zero radius of curvature.

In some cases, the radius of curvature of the second cross-directional cut line may be a first radius of curvature, and a juncture of each of the first and second longitudinal cut lines with the second cross-directional cut line may have a second radius of curvature that is different from the first radius of curvature. The second radius of curvature may be, for example, between approximately 0.125-inch and approximately 0.75-inch.

In some embodiments, the first cross-directional cut line, the first longitudinal cut line, the second longitudinal cut line, and the second cross-directional cut line may form a closed shape. Additionally or alternatively, the first cross-directional cut line of the inner die cut may comprise at least one package integrity feature. The outer die cut and the inner die cut may be formed using a rotary die cutting blade in some cases. The mid-section of the second cross-directional cut line may be cut before the opposite ends of the second cross-directional cut line. In some cases, the outer die cut may include at least one package integrity feature.

In other embodiments, a method of manufacturing a package is provided. The method may include the steps of laminating an outer film layer to an inner film layer; forming an outer die cut in the outer film layer to define a peripheral edge of a peelable flap portion of the package; and forming an inner die cut in the inner film layer to define a location of an opening of the package. The inner die cut may be formed inwardly of the outer die cut and on the peelable flap portion. Formation of the inner die cut may include forming a first cross-directional cut line; forming first and second longitudinal cut lines extending continuously lengthwise from opposite ends of the first cross-directional cut line, respectively; and forming a second cross-directional cut line extending continuously between the first and second longitudinal cut lines opposite the first cross-directional cut line. The second cross-directional cut line may have a non-zero radius of curvature, such that at least a mid-section of the second cross-directional cut line is cut at a different instant in time than opposite ends of the second cross-directional cut line, thereby reducing vibrations generated during cutting.

In some cases, laminating an outer film layer to an inner film layer may comprise pattern-applying a permanent adhesive to first portions of an inner surface of a respective one of the inner film layer or the outer film layer and pattern-applying a pressure sensitive adhesive to second portions of the inner surface of the respective one of the inner or outer film layer. Moreover, the radius of curvature of the second cross-directional cut line may be a first radius of curvature, and a juncture of each of the first and second longitudinal cut lines with the second cross-directional cut line may have a second radius of curvature that is different from the first radius of curvature. The second radius of curvature may, for example, be between approximately 0.125-inch and approximately 0.75-inch.

The first cross-directional cut line, the first longitudinal cut line, the second longitudinal cut line, and the second cross-directional cut line may, in some cases, form a closed shape. The first cross-directional die cut line of the inner die cut may comprise at least one package integrity feature. In some cases, forming the outer die cut and forming the inner die cut comprise may be done using a rotary die cutting blade. The mid-section of the second cross-directional cut line may be cut before the opposite ends of the second cross-directional cut line. In still other cases, the outer die cut may include at least one package integrity feature.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As noted above, some packages for holding food items (e.g., cookies), are designed to be opened by a consumer by peeling back portions of the package that form a peelable portion. When separated from the rest of the package, the peelable portion creates an opening into a main compartment of the package where the contents of the package are held. For example, the package may be made of a laminate that includes two or more film layers. Prior to forming the package, lines may be die cut into each layer of the laminate to define the peelable portion, which in turn may define an opening into the compartment.

Thus, to create the opening, die cuts are made in each film layer. In a two-layer laminate, for example, cut lines made in the outer film layer (e.g., the film layer that defines an exterior surface of the package) may define the general shape of the peelable portion of the package, and cut lines made in the inner film layer may define the general shape of the opening into the package. Accordingly, with respect to at least the inner film layer, some cuts may be made in the same direction as the longitudinal axis of the package (e.g., longitudinal cut lines) and some cuts may be made in a direction that is transverse or perpendicular to the direction of the longitudinal cut lines (e.g., cross-directional cut lines) to define the opening.

Figure 1:
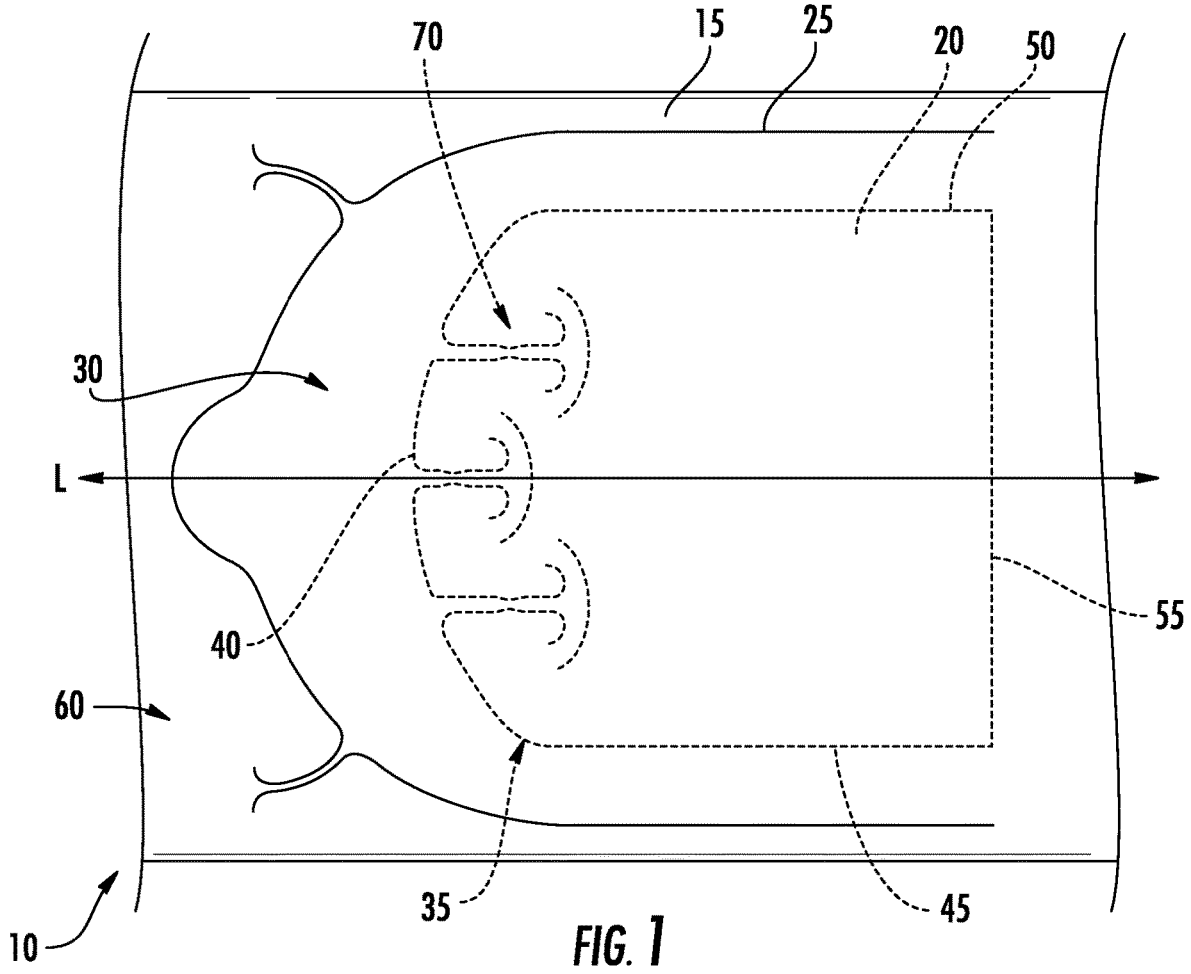
FIG. 1 is a view from the outer film layer-side of the top of a conventional package showing die cuts forming a peelable flap portion and an opening of the package.

A conventional package 10 formed by a laminate including an outer film layer 15 and an inner film layer 20 is shown in FIG. 1. In FIG. 1, the inner film layer 20 is underneath the outer film layer 15. The outer film layer 15 as illustrated includes an outer die cut 25 that defines a peripheral edge of a peelable flap portion 30 of the conventional package 10. The inner film layer 20 includes an inner die cut 35, which defines a location of an opening of the package 10 and is formed inwardly of the outer die cut 25, on the peelable flap portion 30.

The inner die cut 35 includes a first cross-directional cut line 40 (which may in some cases include one or more package integrity features 70, as shown), first and second longitudinal cut lines 45, 50 extending continuously lengthwise from opposite ends of the first cross-directional cut line 40, respectively, and a second cross-directional cut line 55 extending between the first and second longitudinal cut lines 45, 50 with respect to the longitudinal axis L of the package, as shown. The cut lines 40, 45, 50, 55 thus define the general shape of the opening that will be formed in the package once the peelable portion 30 is peeled back from the main body 60 of the package.

According to conventional packages 10 and methods, the second cross-directional cut line 55 is a straight line extending approximately perpendicularly from the first and second longitudinal cut lines 45, 50 and having no curvature. Considering a rotary die cutting process, in which the die cut is formed by a blade edge provided on the circumferential surface of the rotary die cutting tool, according to conventional packages 10 and methods, the blade would have a shape that corresponds to the dashed-line shape in FIG. 1 of the inner die cut 35. Thus, the entire straight-line second cross-directional die cut 55 according to conventional packages 10 and methods would be cut into the inner film layer 20 at the same time, when the rotary die-cutting tool rotates to the point at which the entire straight edge blade portion corresponding to the second cross-directional die cut 55 impacts the inner film layer 20. The inventors have discovered that, as a result of the perpendicular juncture of lines and/or the sudden and simultaneous impact of the entirety of the straight edge blade portion on the material in making the second cross-directional die cut 55, vibrations are created in the rotary die-cutting tool, which unintentionally and intermittently increase and/or decrease the force with which the rotary tool and die cutting blade impact the inner film layer 20 and cause certain portions of the inner die cut 35 to be cut deeper than others. Inconsistent depths of the die cuts may, in some cases, cause one or more of the cut lines 40, 45, 50, 55 or portions thereof to encroach upon or at least partially cut into the material of the adjacent outer film layer 15 or to cause the lines to be cut through less than the thickness of the inner film layer 20 (an incomplete cut), which can affect the overall performance or appearance of the conventional package.

Through ingenuity and hard work, the inventors have discovered that replacing the straight-line second cross-directional cut line with a cut line that has a nominal radius of curvature (or, in some cases, multiple radii of curvature) can serve to reduce vibrations in the cutting of the various die cuts by providing a gradual impact of the rotary die cutting tool and blade with the material of the inner film layer. In this way, a more consistent depth of cut can be produced, the tolerance for the various die cuts can be minimized, and the overall performance of the peelable portion can be enhanced.

Turning now to FIGS. 2A-2E, a flexible package 100 according to embodiments of the present invention is shown, such as a package designed for holding food items such as cookies 110. The package 100 may include a main body 160 and a peelable flap portion 130. The main body 160, for example, may define a compartment configured to hold contents (e.g., cookies 110) therein. In some embodiments, the peelable flap portion 130 may be configured to be peeled away from the main body 160 by the user, as depicted in FIGS. 2A-2E.

The flexible package 100 may, in some embodiments, include an outer film layer 115 and an inner film layer 120. Accordingly, in some embodiments, the inner and outer film layers 120, 115 may define the main body 160 and the peelable flap portion 130. For example, the outer film layer 115 may include an outer die cut 125, and the outer die cut may define a peripheral edge of the peelable flap portion 130 of the package, as shown. The inner film layer 120 may be laminated to the outer film layer 115 using permanent adhesive in some areas and pressure sensitive adhesive in other areas. For example, permanent adhesive may be pattern-applied to first portions 118 of a respective one of an inner surface 133 of the outer film layer 115 or an outer surface 134 of the inner film layer 120, such as in portions that lie outwardly of the outer die cut 125, and pressure sensitive adhesive may be pattern applied to second portions 119 of the respective surface of the inner or outer film layer, such as in portions covering areas of the films that are intended to delaminate. Thus, in the depicted embodiment, the second portions 119 may be areas of the laminate that lie between the outer die cut 125 and the inner die cut 135 (shown in FIG. 2B, for example).

Figure 2A:
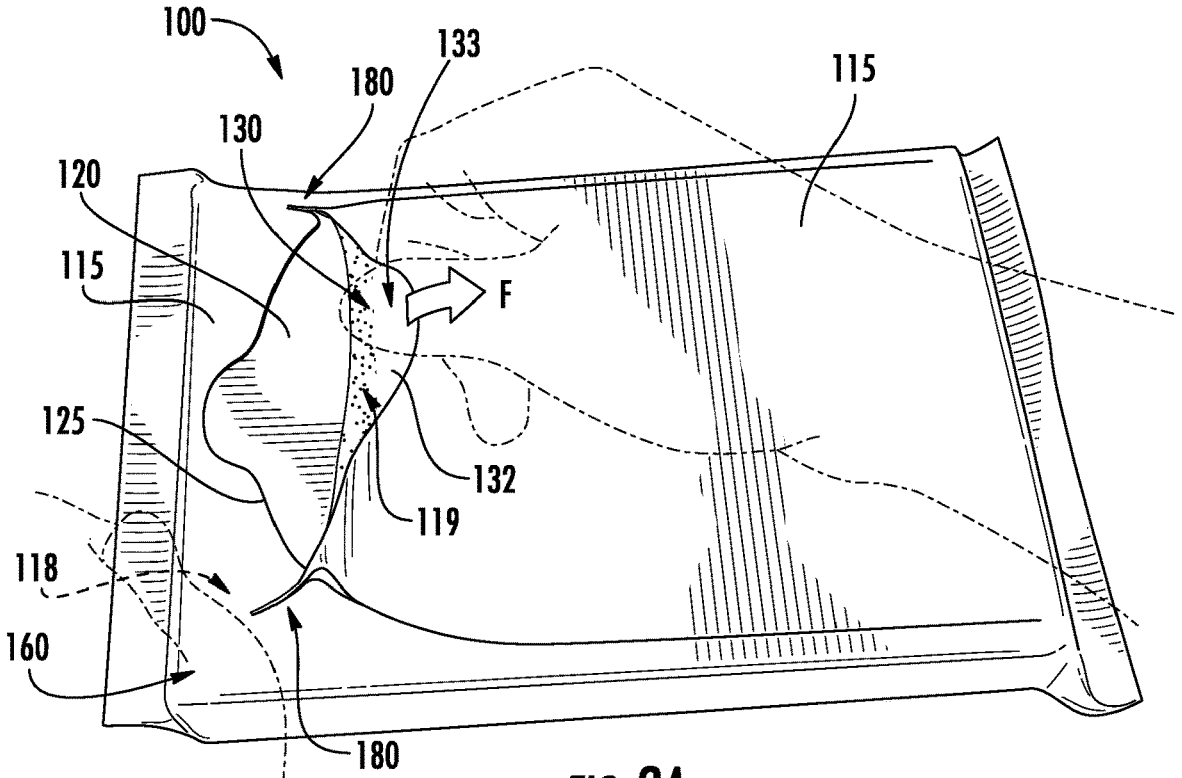
FIGS. 2A-2E illustrate perspective views of a progression of opening a package by peeling the peelable flap portion away from a main body of the package according to an example embodiment.

Due to the presence of the pressure sensitive adhesive in the second portions 119 and the location of the second portions 119 with respect to the location of the outer die cut 125, the outer film layer 115 may delaminate from the inner film layer 120 as the user grasps a pull tab 132 defined by the outer die cut 125 and applies an opening force F, as shown in FIG. 2A. In some cases, the pull tab 132 may be defined by the outer die cut 125 to have a semi-circular or semi-elliptical shape that extends outwardly from the general shape of the rest of the outer die cut 125, as illustrated in FIG. 2A, for example, and an inner surface 133 of the pull tab 132 (e.g., the surface that contacts or is adjacent to the outer surface 134 of the inner film layer 120) and the corresponding outer surface 134 of the inner film layer 120 may be devoid of any adhesives, such that the pull tab may be easily separated from the package 100 (e.g., by the user sliding a finger between the pull tab 132 and the rest of the package 100). In this way, the user may grasp the pull tab 132 and use it to pull the peelable flap portion 130 away from the main body 160 of the package 100, as illustrated in FIGS. 2A-2E.

Figure 2B:
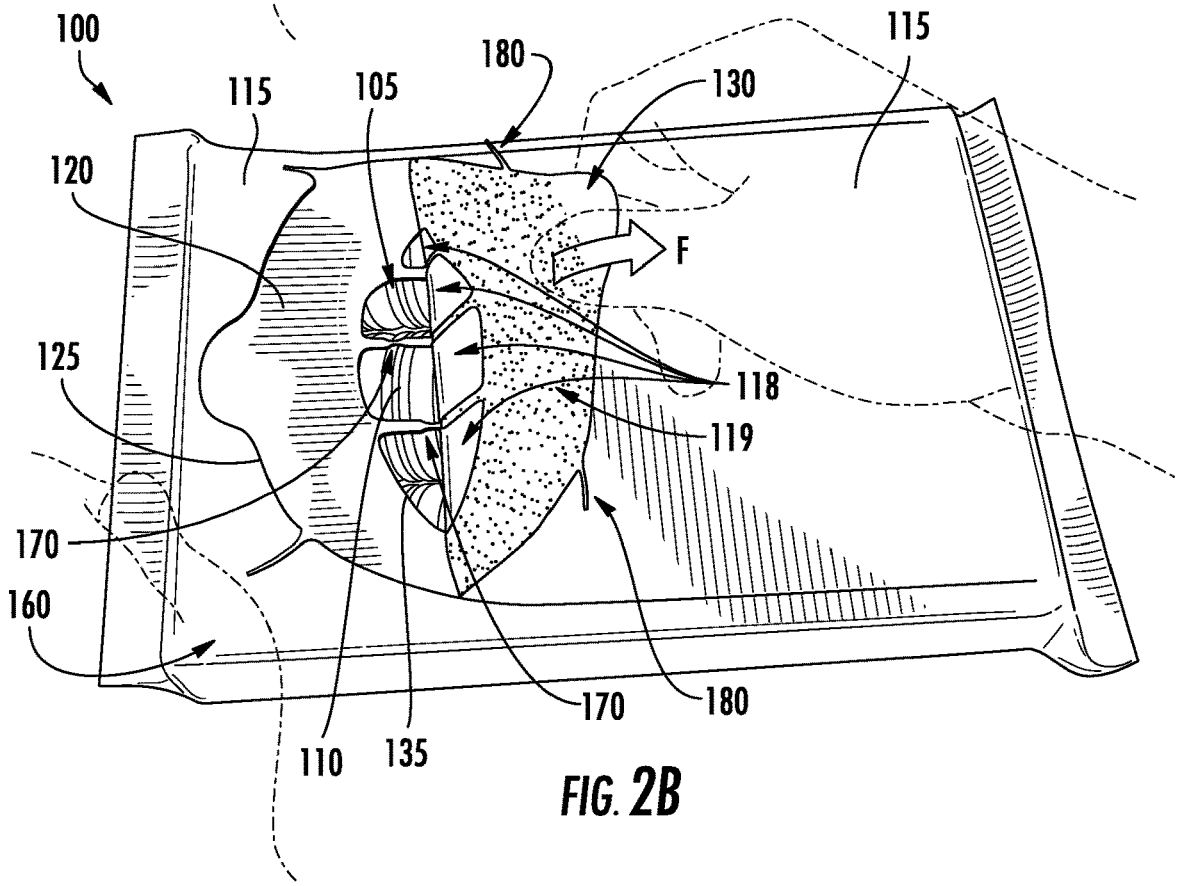
Figure 2C:
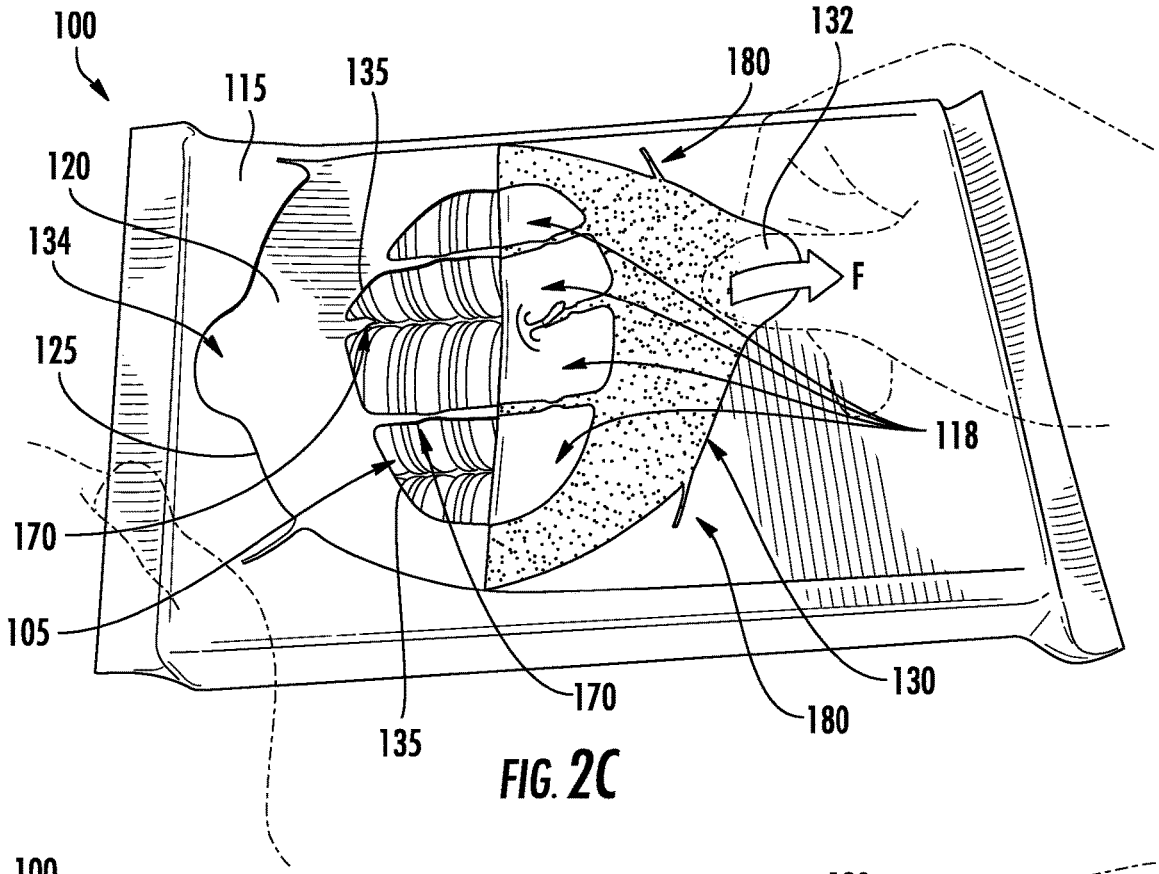
Figure 2D:
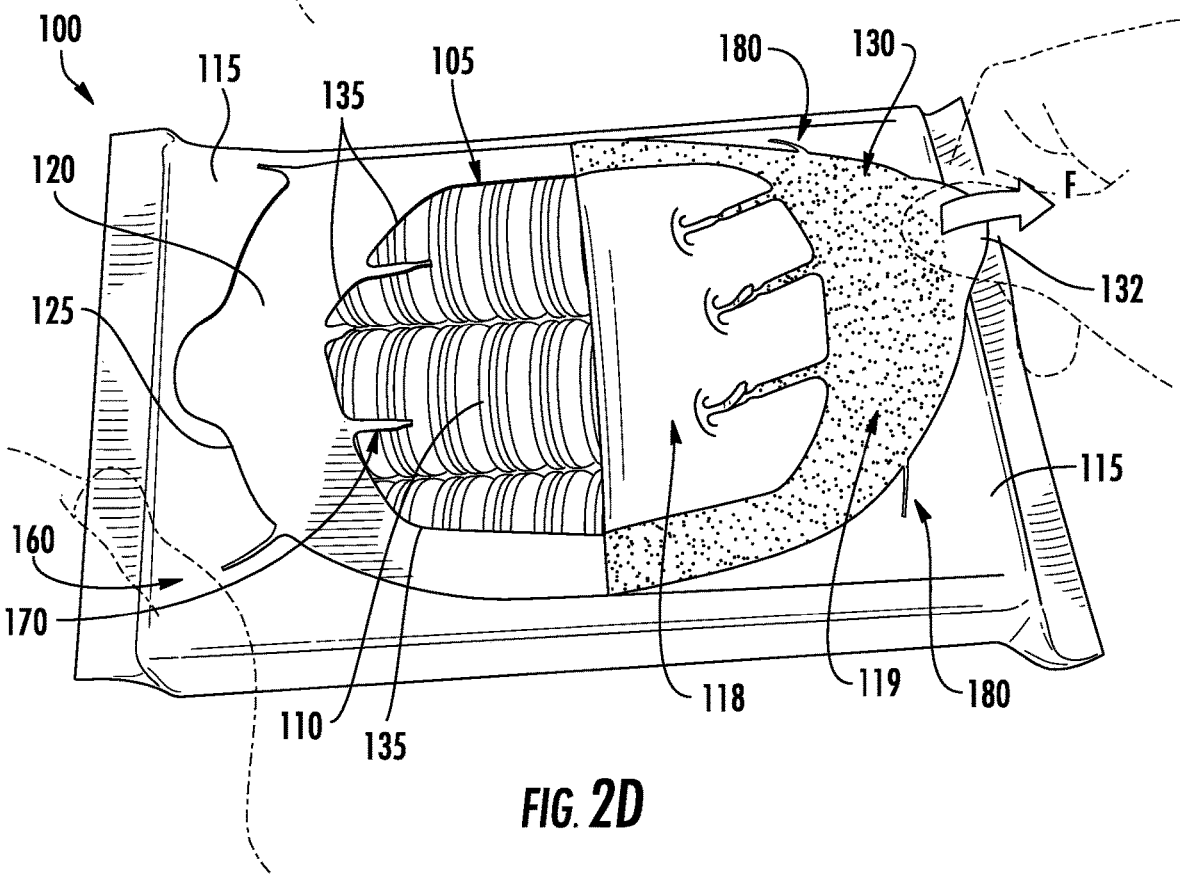
Figure 2E:
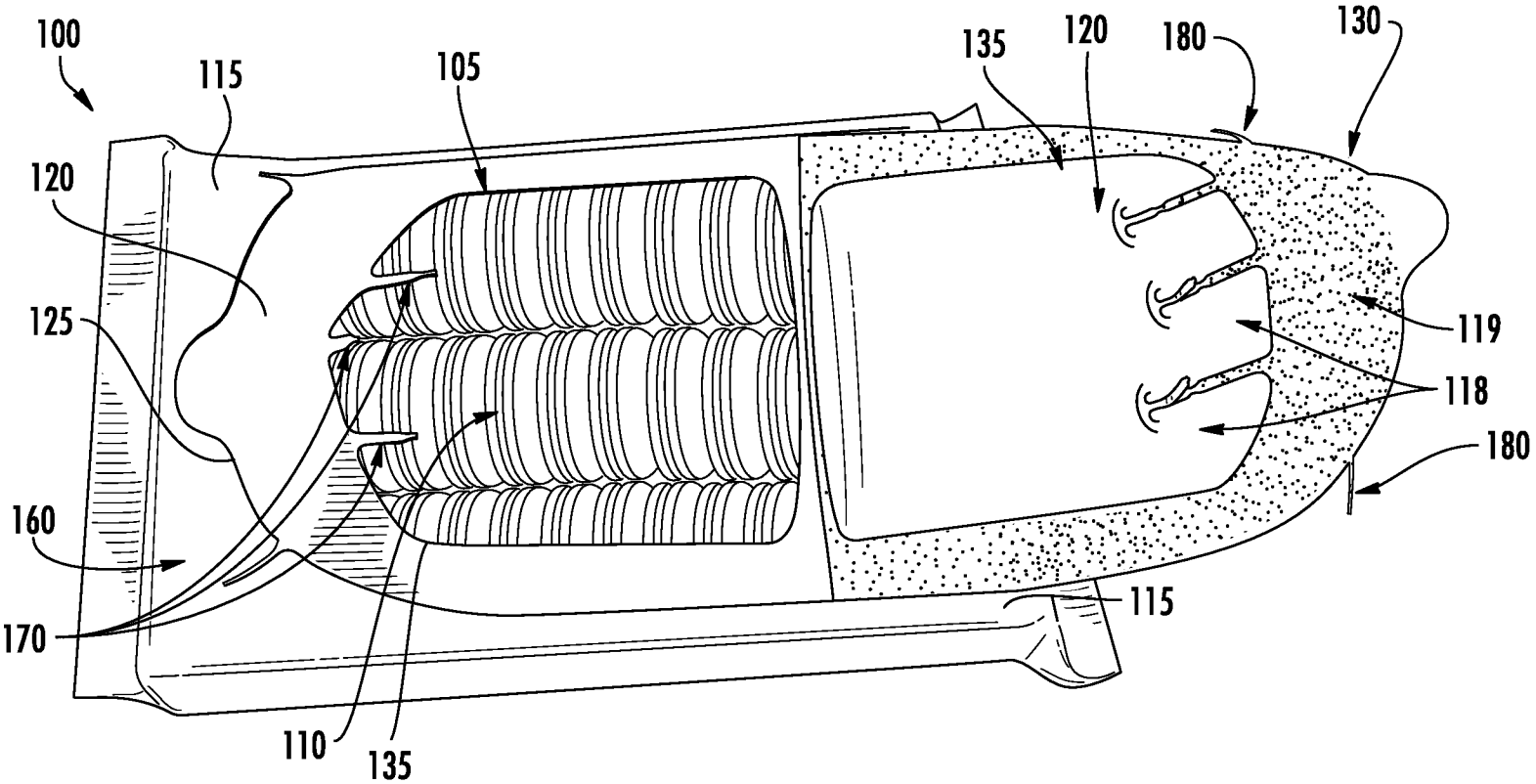

As the user continues to apply the opening force F and pulls the peelable portion 130 away from the main body 160 of the package, an opening 105 of the package 100 may be revealed due in part to the presence of the inner die cut 135, as shown in FIGS. 2B-2E. For example, portions inward of the inner die cut 135 may be additional first portions 118 in which permanent adhesive has been applied to keep the inner and outer film layers 120, 115 laminated to each other. In this way, the peeling back of the peelable flap portion 130 as shown in FIGS. 2B-2E serves to create the opening 105 by removing a part of the inner film layer 120 as the outer film layer 115 is removed or peeled back. Thus, the inner die cut 135 defines a location of the opening 105 of the package 100 and is formed inwardly of the outer die cut 125, on the peelable flap portion 130. In FIG. 2E, the user has pulled back the peelable flap portion 130 to reveal the complete opening 105 defined by the inner die cut 135.

Figure 3:
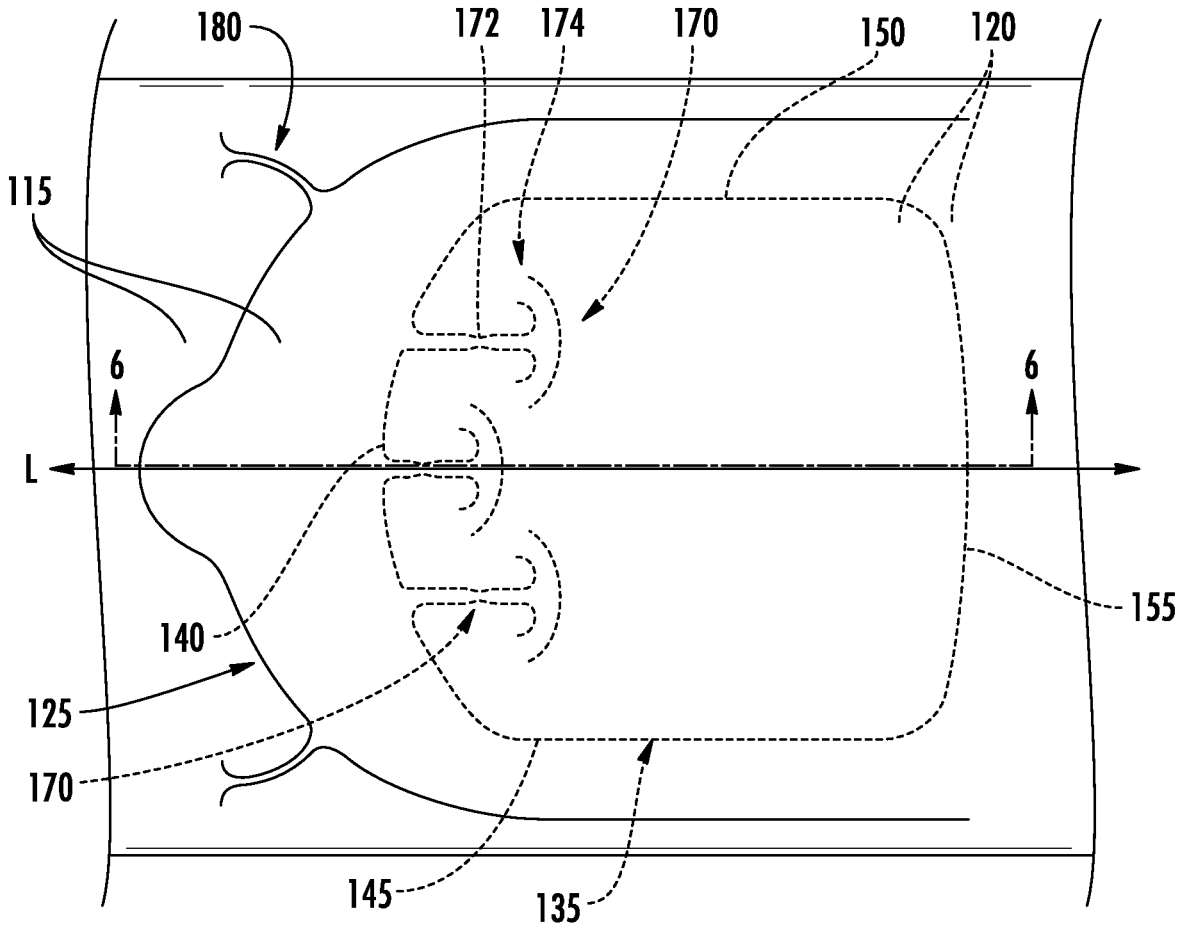
FIG. 3 is a view from the outer film layer-side of the top of the package shown in FIGS. 2A-2E according to an example embodiment.
Figure 4:
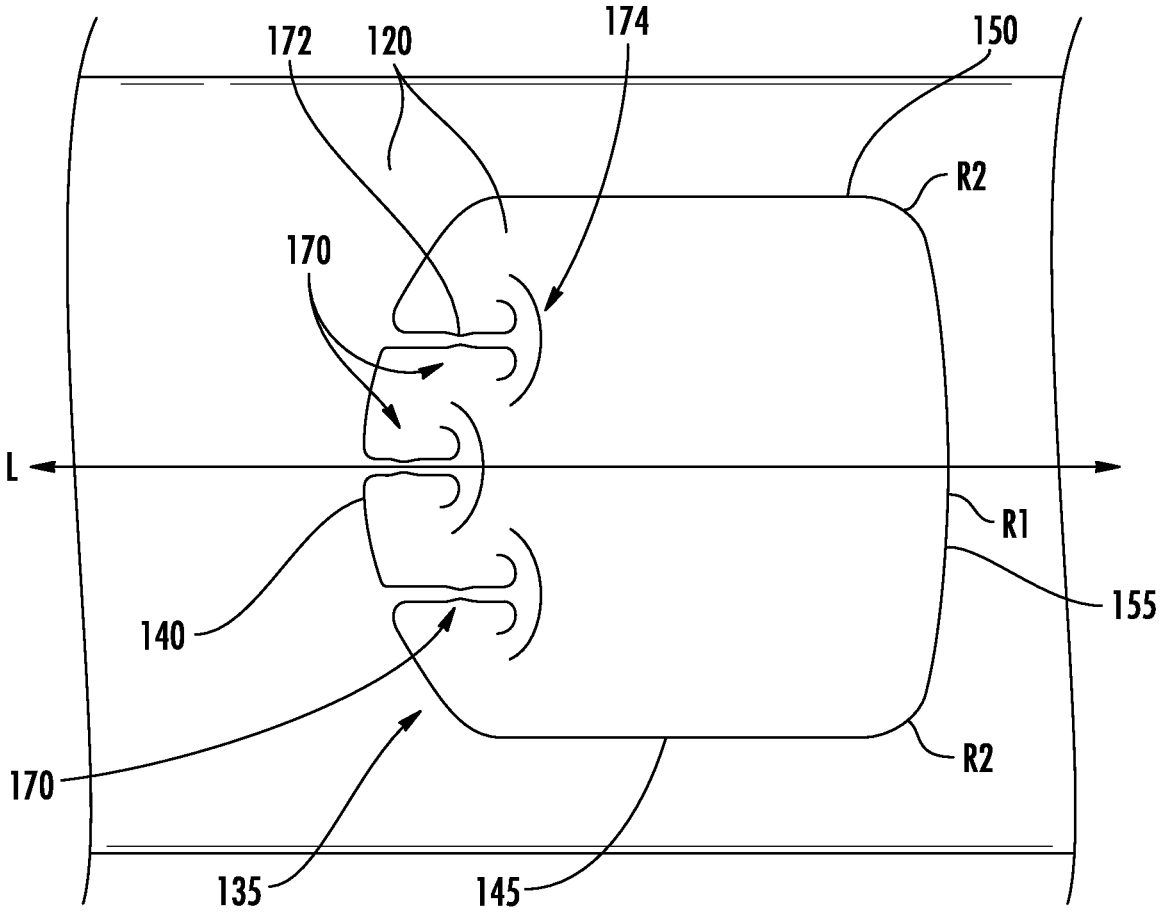
FIG. 4 is a view from the outer film layer-side of the top of the package shown in FIGS. 2A-2E according to an example embodiment with the outer film layer removed for clarity.
Figure 6:
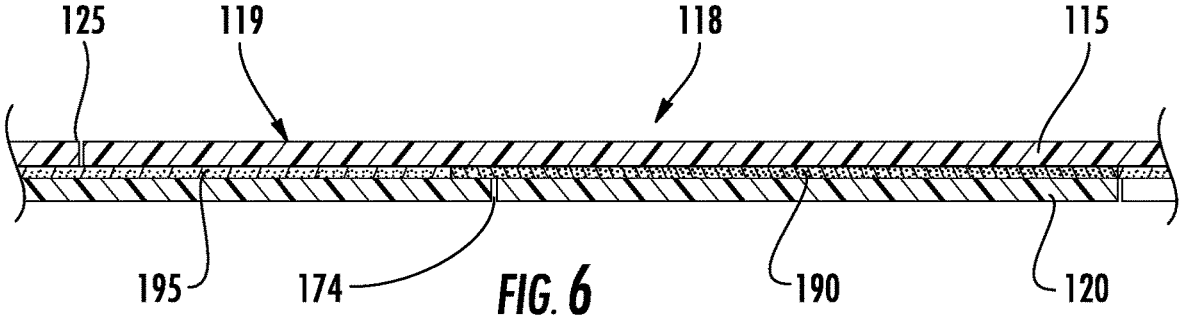
FIG. 6 is a partial cross-sectional view of the top of the package shown in FIG. 3 according to an example embodiment.

FIGS. 3 and 4 illustrate the configurations of the inner die cut 135 and the outer die cut 125 when viewed from the top of the closed package 100 (e.g., before a user has begun to pull the peelable flap portion 130 away from the main body 160 of the package, such as before the action shown in FIG. 2A). FIG. 6 illustrates a cross-section of the inner and outer film layers 120, 115 and the adhesive layer disposed therebetween (including sections of permanent adhesive 190 and pressure sensitive adhesive 195) of the top of the package taken along line 6-6 of FIG. 3. As shown in FIGS. 3 and 4, according to some embodiments, the inner die cut 135 includes a first cross-directional cut line 140 and first and second longitudinal cut lines extending continuously lengthwise from opposite ends of the first cross-directional cut line 140, respectively, in the same direction as the longitudinal axis L of the package. To complete the shape of the opening 105 (FIG. 2E) to be revealed as the peelable flap portion 130 is pulled back all the way, the inner die cut 135 further includes a second cross-directional cut line 155 extending continuously between the first and second longitudinal cut lines opposite the first cross-directional cut line 140. In contrast to conventional packages, in which the second cross-directional cut line 55 is straight and extends approximately perpendicularly from the longitudinal cut lines 45, 50, and thus has no radii of curvature (shown in FIG. 1 and described above), embodiments of the present invention provide for a second cross-directional cut line 155 that has at least one non-zero radius of curvature, as illustrated in FIGS. 3 and 4.

Because the second cross-directional cut line 155 shown in FIGS. 3 and 4 has at least one non-zero radius of curvature, at least a mid-section of the second cross-directional cut line (e.g., a portion of the cut line closest to the longitudinal axis L) is cut at a different instant in time than opposite ends of the second cross-directional cut line (e.g., the ends that continuously join with corresponding ends of the first and second longitudinal cut lines 145, 150) when the laminate is, for example, passed through a rotary die cutter. For example, in a case in which the laminate material is fed into the rotary die cutter in a direction from right to left with respect to the view shown in FIGS. 3 and 4, the first cross-directional cut line 140 may be cut first, followed by the first and second longitudinal cut lines 145, 150 (the two lines being cut simultaneously with each other, from the respective ends closest to the first cross-sectional cut line 140 to the respective opposite ends closest to the second cross-directional cut line 155), followed by the ends of the second cross-directional cut line 155, and finally followed by the remainder of the second cross-directional cut line (e.g., working inward from the opposite ends to the mid-section).

In other cases, in which the laminate material is fed into the rotary die cutter in a direction from left to right, the mid-section of the second cross-directional cut line 155 (e.g., starting from near the center point of that line) may be cut first, with the cut gradually extending outwardly towards the opposite ends of the second cross-directional cut line, followed by cutting of the first and second longitudinal cut lines 145, 150 (the two lines being cut simultaneously with each other, from the respective ends closest to the second cross-sectional cut line 155 to the respective opposite ends closest to the first cross-directional cut line 140), and finally followed by the first cross-directional cut line 140.

Regardless of which direction the laminate is advanced through the rotary die cutter, the relatively gradual cutting of the second cross-directional cut line 155 as described above has been found by the inventors to reduce the vibrations generated during the die cutting process and has led to more consistent die cutting depths and reduced tolerances. For example, preliminary testing by the inventors shows that the tolerances are improved by up to 50% to +/−6 microns for packages having an inner die cut 135 made according to embodiments described herein, as compared to tolerances of +/−12 microns for conventional packages with a straight die cut having no radius of curvature.

With reference to FIG. 4, for example, in which the outer film layer 115 is removed for purposes of explanation, the radius of curvature R1 of the second cross-directional cut line 155 may vary based on the size of the package and the width of the opening 105. In some cases, the second cross-directional cut line 155 includes only one radius of curvature R1. In other cases, however, as illustrated in FIG. 4, for example, the radius of curvature of the second cross-directional cut line 155 is a first radius of curvature R1, and the juncture of each of the first and second longitudinal cut lines 145, 150 with the second cross-directional cut line has a second radius of curvature R2 that is different from the first radius of curvature R1. For example, in some embodiments, the second radius of curvature R2 may be between approximately 0.125-inch and approximately 0.75-inch. In this way, rather than an abrupt intersection of the second cross-directional line 155 with each of the first and second longitudinal cut lines 145, 150, the extension of one cut line into the other can be made more gradually, and vibrations can be further reduced as a result (e.g., because the lines are joined by a curve, rather than coming together at a point).

In some embodiments, the first and/or second radii of curvature R1, R2 may be selected so as to provide a second cross-directional cut line 155 that, although not a straight line, minimizes the degree of curvature may to allow the opening 105 to remain within the working area of the package, such that the rightmost point of the opening (with respect to the depicted views in the figures) does not extend too far towards the end of the package. At the same time, using a first and/or second radius of curvature R1, R2 that is too large may require that the first and second longitudinal cut lines 145, 150 be shortened (e.g., as compared to the lengths shown in the embodiments of the figures), which would effectively reduce the access area provided by the opening 105. Moreover, minimizing the degree of curvature of one or more of the radii R1, R2 may allow the second cross-directional cut line 155 to appear, to the eyes of a consumer, no different than a conventional second cross-directional cut line, thereby minimizing the visual impact of embodiments of the new package as compared to a conventional package.

As illustrated in FIGS. 2A-5, in some embodiments the package 100 may include one or more package integrity features. For example, in some cases, the inner die cut 135 may be formed such that the first cross-directional cut line 140 comprises at least one package integrity feature 170. In the depicted embodiments, for example, the first cross-directional cut line 140 includes three package integrity features 170. Moreover, in some cases, the outer die cut 125 may additionally or alternatively include at least one package integrity feature 180. The package integrity features 170, 180 may be formed via one or more die cuts (continuous or discontinuous) that are configured (e.g., sized, shaped, and/or arranged with respect to each other and other die cuts) to cause the material of the respective film layer 115, 120 in which the package integrity feature is formed to deform and/or tear so as to provide an indication to a user that the package was previously opened.

For example, with reference to FIGS. 2A-2E, the package integrity features 180 of the outer die cut 125 defined in the outer film layer 115 are configured so as to create strips of material that are stretched and torn (e.g., as the peelable flap portion 130 is moved from the position shown in FIG. 2A to the position shown in FIG. 2B) and hang from the peelable flap portion 130, thereby providing a visual indication to the user that the peelable flap portion was previously peeled back to expose at least part of the opening 105. Similarly, the package integrity features 170 formed in the inner die cut 135 of the inner film layer 120 may be configured to stretch and tear as the peelable flap portion 130 is moved from the position shown in FIG. 2B, for example, to the position shown in FIG. 2D through the continued application of the opening force F by the user, as depicted. Again, the presence of the deformed and/or torn package integrity features 170 may provide at least a visual indication to the user that the peelable flap portion 130 has already been opened and that the contents of the package 100 may have previously been accessed.

With respect to the package integrity features 170 defined in the inner film layer 120, for example, each package integrity feature may comprise a neck region 172, as well as an anchor region 174, as illustrated in FIGS. 3 and 4. The neck region 172 may have a reduced width and may be configured to tear as an opening force F (shown in FIGS. 2A-2E) is applied to the peelable flap portion 130 by a user to peel the peelable flap portion from the main body 160 and create the opening 105 of the package. The anchor region 174 may be configured to resist the opening force F applied by the user such that the neck region 172 tears in response to application of the opening force F on the respective package integrity feature 170 (e.g., tearing when the opening force experienced by the particular package integrity feature reaches a certain threshold amount of force).

In FIGS. 2A and 2B, for example, the user has not yet applied an opening force F over a great enough distance (e.g., has not peeled the peelable flap portion 130 far enough back) to tear any of the package integrity features 170; in FIG. 2C, the peelable flap portion has been peeled back such that one of the package integrity features 170 (the centrally located one) has experienced an amount of opening force F sufficient to cause that package integrity feature to tear at its neck region 172 (shown in FIGS. 3 and 4); and in FIGS. 2D and 2E, the peelable flap portion has been peeled back far enough such that each of the three depicted package integrity features 170 have experienced the sufficient amount of opening force F to tear at the respective neck regions 172. In other words, because one end of each package integrity feature 170 is connected to the peelable flap portion 130 via the anchor region 174 and the other end of the respective package integrity feature is connected to the main body 160 of the package, and because the peelable flap portion is being pulled away from the main body by the user's action of opening the package 10 as shown in FIGS. 2A-2E, each package integrity feature 170 is stretched until the point at which it tears (e.g., at the neck region 172, as illustrated).

In this regard, in some embodiments, the anchor region 174 may be specifically configured (e.g., sized, shaped, and/or arranged) so as to maintain a secure attachment to the outer film layer 115 of the peelable flap portion 130, e.g., as a result of adhesives applied between adjacent, contacting surfaces of the inner and outer film layers 120, 115 in the area of the anchor region 174. For example, in the embodiment depicted in FIGS. 3 and 4, the anchor region 174 may consist of discontinuous die cut lines, such as two hooked ends with an arched line spaced therefrom.

Figure 5:
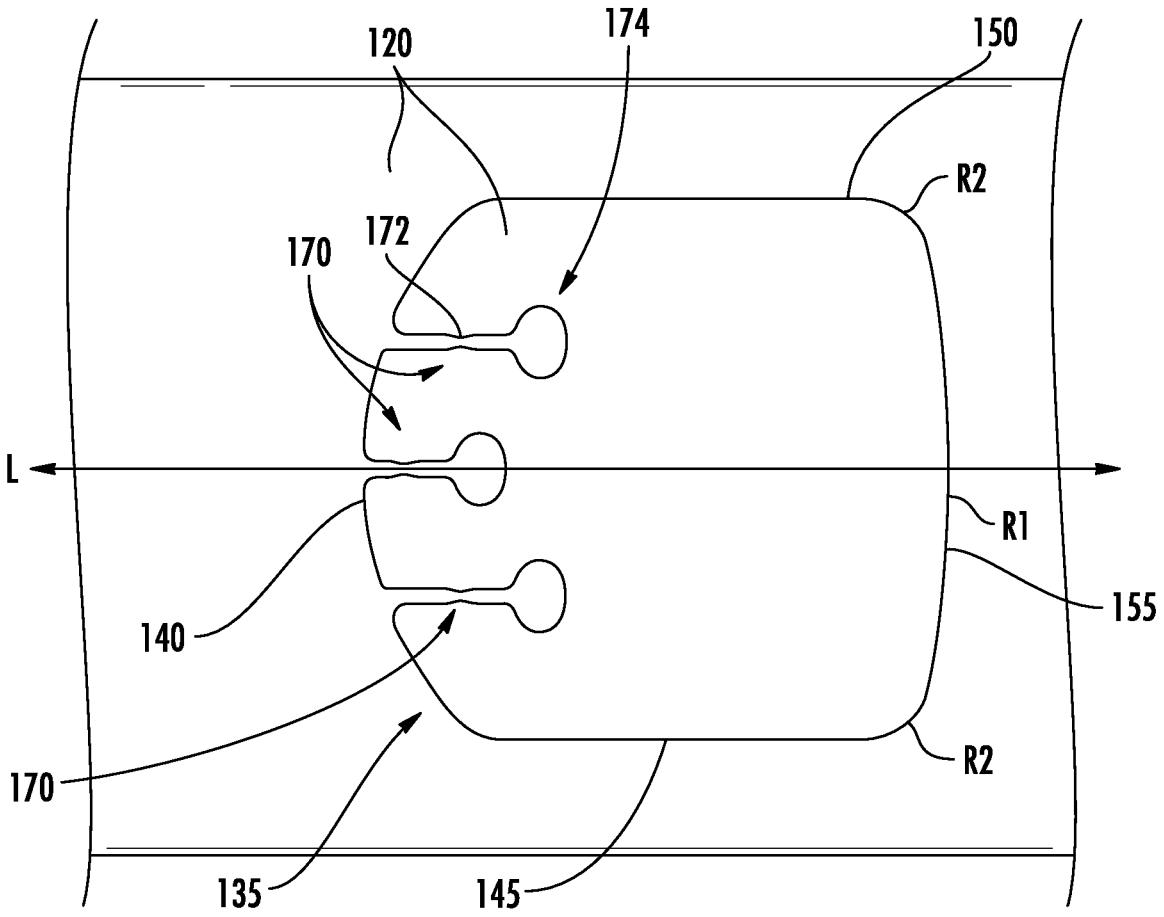
FIG. 5 is a view from the outer film layer-side of the top of the package shown in FIGS. 2A-2E according to another example embodiment with the outer film layer removed for clarity.

In other embodiments, however, such as the embodiment shown in FIG. 5, the package integrity feature 170 may be configured to have an anchor region 174 that is formed of a die cut line that is continuous with the die cut lines forming the neck region 172, the rest of the package integrity feature 170, and the rest of the first cross-directional cut line 140 and other cut lines 145, 150, 155 that form the location of the opening to be created when the peelable flap portion is pulled back. For example, the anchor region 174 may be configured to be circular or elliptical, as shown in FIG. 5, such that the first cross-directional cut line 140, the first longitudinal cut line 145, the second longitudinal cut line 150, and the second cross-directional cut line 155 form a closed shape.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of manufacturing a package, the method comprising:

laminating an outer film layer to an inner film layer;

forming an outer die cut in the outer film layer to define a peripheral edge of a peelable flap portion of the package; and forming an inner die cut in the inner film layer to define a location of an opening of the package, wherein the inner die cut is formed inwardly of the outer die cut, and wherein forming the inner die cut comprises:

forming a first cross-directional cut line;

forming first and second longitudinal cut lines extending continuously lengthwise from opposite ends of the first cross-directional cut line, respectively; and forming a second cross-directional cut line extending continuously between the first and second longitudinal cut lines opposite the first cross-directional cut line and extending outwardly from the first cross-directional cut line, wherein the second cross-directional cut line has a non-zero first radius of curvature at a location between its juncture with the first and second longitudinal cut lines, and a non-zero second radius of curvature at the juncture of each of the first and second longitudinal cut lines with the second cross-directional cut line, wherein the second radius of curvature is between approximately 0.125-inch and approximately 0.75-inch and is smaller than the first radius of curvature.

2. The method of claim 1, wherein laminating an outer film layer to an inner film layer comprises pattern-applying a permanent adhesive to first portions of an inner surface of a respective one of the inner film layer or the outer film layer and pattern-applying a pressure sensitive adhesive to second portions of the inner surface of the respective one of the inner or outer film layer.

3. The method of claim 1, wherein the first cross-directional cut line, the first longitudinal cut line, the second longitudinal cut line, and the second cross-directional cut line form a closed shape.

4. The method of claim 1, wherein the first cross-directional cut line of the inner die cut comprises at least one package integrity feature.

5. The method of claim 1, wherein forming the outer die cut and forming the inner die cut comprise using a rotary die cutting blade.

6. The method of claim 1, wherein a mid-section of the second cross-directional cut line is cut before opposite ends of the second cross-directional cut line are cut.

7. The method of claim 1, wherein a mid-section of the second cross-directional cut line is disposed further from a midpoint of the peelable flap portion than the juncture of each of the first and second longitudinal cut lines with the second cross-directional cut line is disposed from a midpoint of each of the first and second longitudinal cut lines.

8. The method of claim 1, wherein the outer die cut includes at least one package integrity feature.

9. The method of claim 1, wherein the first and second radii of curvature are selected so as to provide the second cross-directional cut line that, although not a straight line, minimizes the curvature of the second cross-directional cut line.

10. The method of claim 1, wherein the first and second radii of curvature are selected so as to provide the second cross-directional cut line that, although not a straight line, simulates the appearance of a straight line.

11. A method of manufacturing a package, the method comprising:

laminating an outer film layer to an inner film layer;

forming an outer die cut in the outer film layer to define a peripheral edge of a peelable flap portion of the package; and forming an inner die cut in the inner film layer to define a location of an opening of the package, wherein the inner die cut is formed inwardly of the outer die cut, and wherein forming the inner die cut comprises:

forming a first cross-directional cut line;

forming first and second longitudinal cut lines extending continuously lengthwise from opposite ends of the first cross-directional cut line, respectively; and forming a second cross-directional cut line extending continuously between the first and second longitudinal cut lines opposite the first cross-directional cut line and extending outwardly from the first cross-directional cut line, wherein the second cross-directional cut line has a non-zero first radius of curvature at a location between its juncture with the first and second longitudinal cut lines, and a non-zero second radius of curvature at the juncture of each of the first and second longitudinal cut lines with the second cross-directional cut line, wherein the second radius of curvature is smaller than the first radius of curvature, and wherein the first and second radii of curvature are selected so as to provide the second cross-directional cut line such that at least a mid-section of the second cross-directional cut line is cut at a different instant in time than opposite ends of the second cross-directional cut line, thereby reducing vibrations generated during cutting.

12. The method of claim 11, wherein the first and second radii of curvature are selected so as to provide the second cross-directional cut line that, although not a straight line, minimizes the curvature of the second cross-directional cut line.

13. The method of claim 11, wherein the first and second radii of curvature are selected so as to provide the second cross-directional cut line that, although not a straight line, simulates the appearance of a straight line.

14. The method of claim 11, wherein the first radius of curvature is located at a midsection of the second cross-directional cut line.

15. The method of claim 11, wherein the first radius of curvature is located at a portion of the second cross-directional cut line closest to a longitudinal axis of the package.

16. The method of claim 11, wherein laminating an outer film layer to an inner film layer comprises pattern-applying a permanent adhesive to first portions of an inner surface of a respective one of the inner film layer or the outer film layer and pattern-applying a pressure sensitive adhesive to second portions of the inner surface of the respective one of the inner or outer film layer.

17. The method of claim 11, wherein forming the outer die cut and forming the inner die cut comprise using a rotary die cutting blade.

18. The method of claim 11, wherein a mid-section of the second cross-directional cut line is cut before opposite ends of the second cross-directional cut line are cut.

19. The method of claim 11, wherein a mid-section of the second cross-directional cut line is disposed further from a midpoint of the peelable flap portion than the juncture of each of the first and second longitudinal cut lines with the second cross-directional cut line is disposed from a midpoint of each of the first and second longitudinal cut lines.

* * * * *